US006333717B1

(12) United States Patent
Podger

(10) Patent No.: US 6,333,717 B1
(45) Date of Patent: Dec. 25, 2001

(54) DIAGONAL SUPPORTING CONDUCTORS FOR LOOP ANTENNAS

(76) Inventor: James Stanley Podger, 55 Gradwell Dr., Scarborough, ON (CA), M1M 2N1

( * ) Notice: Subject to any disclaimer, the term of this patent is extended or adjusted under 35 U.S.C. 154(b) by 0 days.

(21) Appl. No.: 09/820,823

(22) Filed: Mar. 30, 2001

(30) Foreign Application Priority Data

Jan. 12, 2001 (CA) ..... 2331347

(51) Int. Cl.[7] ..... H01Q 11/12
(52) U.S. Cl. ..... 343/741; 343/742; 343/867
(58) Field of Search ..... 343/741, 742, 343/743, 744, 866, 867, 878

(56) References Cited

U.S. PATENT DOCUMENTS 4,021,811 * 5/1977 Bastian ..... 343/742
4,152,708 * 5/1979 Boucher ..... 343/880
4,229,742 * 10/1980 Rotunda ..... 343/742
4,236,160 * 11/1980 Johnson ..... 343/741
4,250,507 * 2/1981 Wingard ..... 343/742
4,595,928 * 6/1986 Wingard ..... 343/742
5,900,842 * 5/1999 Coleman ..... 343/742
5,966,100 10/1999 Podger .
6,020,857 2/2000 Podger .
6,104,353 * 8/2000 Diamond et al. ..... 343/725

OTHER PUBLICATIONS

Dodd, Peter, "Design of An All–Metal Quad," *The Antenna Experimenter's Guide*, 2nd Ed. (Potters Bar, Hertfordshire: Radio Society of Great Britain, 1996), pp. 98–99.
Podger, J. S., Analysis Results, Two Meter Quad, No Date.
Podger, J. S., Analysis Results, Two Meter Strengthened Quad, No. Date.
Podger, J. S., Analysis Results, Two Meter Quad Strengthened By Diagonal Conductors, No. Date.

* cited by examiner

*Primary Examiner*—Tho Phan

(57) ABSTRACT

Supporting conductors for loop antennas that are positioned within the principal H plane of the loop antennas and positioned diagonally with respect to the plane of the loops.

9 Claims, 3 Drawing Sheets

DIAGONAL SUPPORTING CONDUCTORS FOR LOOP ANTENNAS

FIELD OF THE INVENTION

This invention concerns the means of supporting loop antennas. This is the U.S. version of Canadian patent application 2,331,347.

SUMMARY OF THE INVENTION

Previous disclosures have shown that it is practicable and desirable to support loop antennas with conductors connected directly across the loops from a balanced feed point to the opposite side of the loops. This is more desirable than supporting such loops with long insulators that can be broken more easily by bad weather. This disclosure shows that it also is possible to support such loops with conductors that are placed in the plane that is perpendicular to the plane of the loops. Particularly, it is convenient to have such supporting conductors mounted diagonally with respect to the plane of the loops. Hereinafter in this description and the attached claims, such conductors will be called diagonal supporting conductors. In some cases, such supports may be less heavy and less expensive than the combination of the supports directly across the loops plus the usual supporting boom. In other cases, it is a considerable advantage that such diagonal supporting conductors can reduce the motion of the loops in the wind and, thereby, preserve the proper electrical operation of the antenna in the wind.

LIST OF DRAWINGS

The background of this invention as well as the objects and advantages of the invention will be apparent from the following description and appended drawings, wherein.

PRIOR ART

Figure 1:
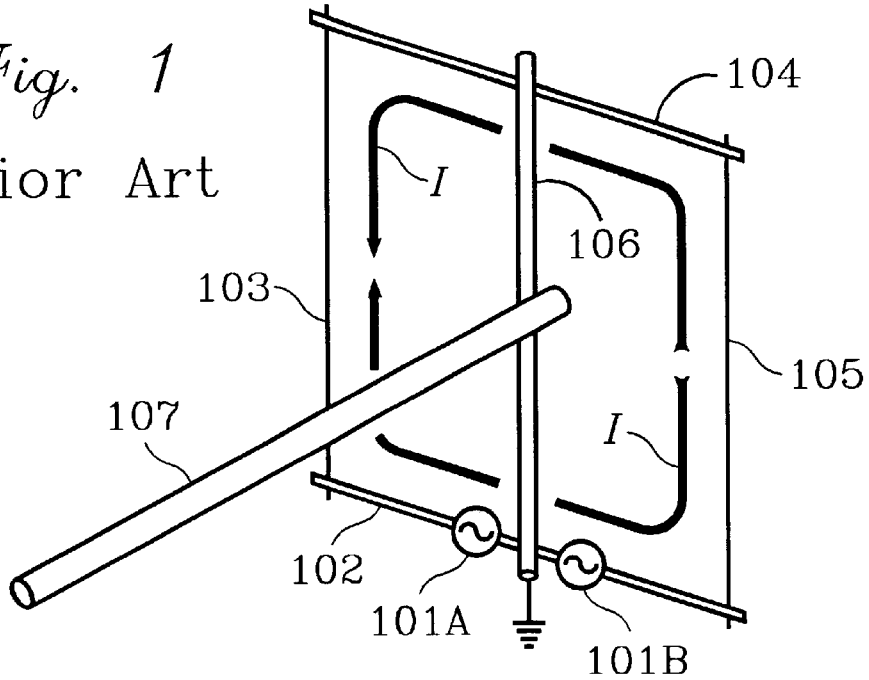
Fig. 1 Prior Art
FIG. 1 illustrates a perspective view of a loop antenna element with a supporting conductor connected directly across the loop.

U.S. Pat. No. 6,020,857 on The Strengthened Quad Antenna Structure disclosed that it was possible and desirable to support one-wavelength loop antenna elements with conductors connected directly across the loop from the balanced feed point to the opposite point of the loop. This is illustrated by FIG. 1, with parts 101A, 101B, and parts 102 to 107. The justification for this action, as was explained in that patent, will follow but, first, the diagrams require some explanation.

In these diagrams, the parts are generally numbered according to their function. That is, although the loop in FIG. 1 could be made from one bent conductor, it is convenient to assign a number to each of the four sides of the loop. Therefore, the whole of the bottom side of the loop is assigned one number, 102, even though it is broken by the generator symbols.

Figure 2:
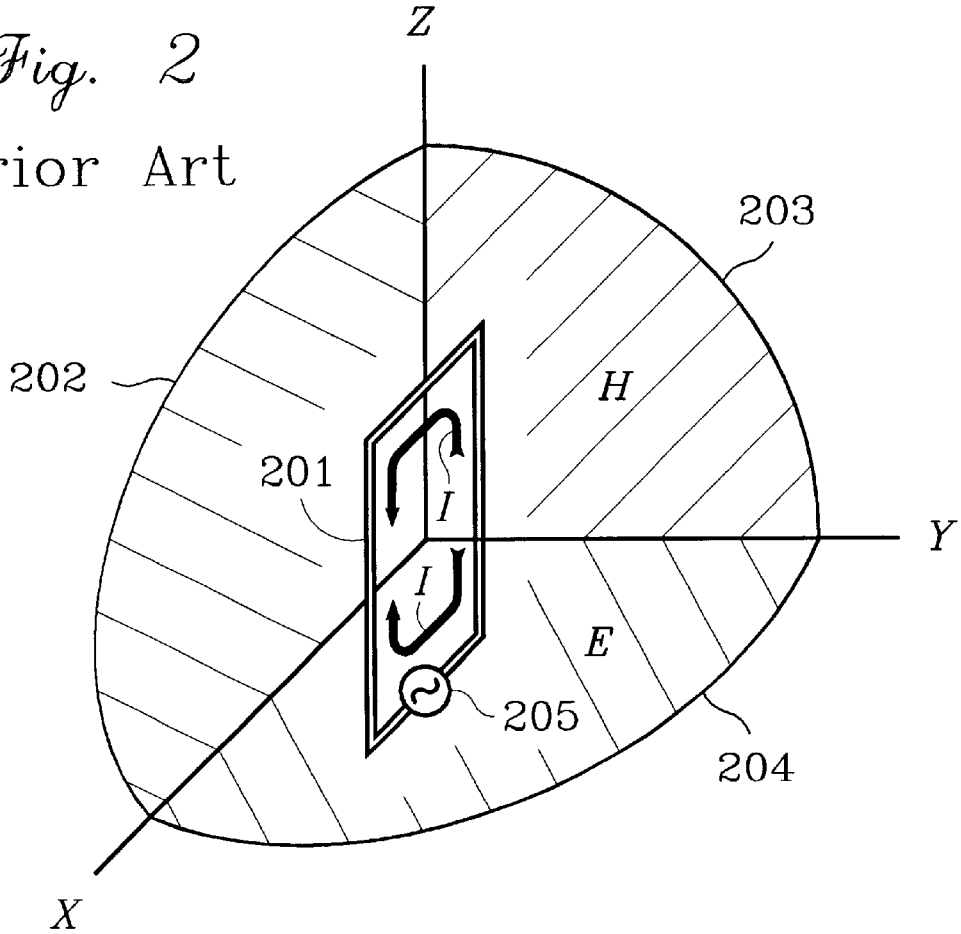
Fig. 2 Prior Art
FIG. 2 illustrates the conventional principal planes passing through a rectangular loop antenna element.
Figure 3:
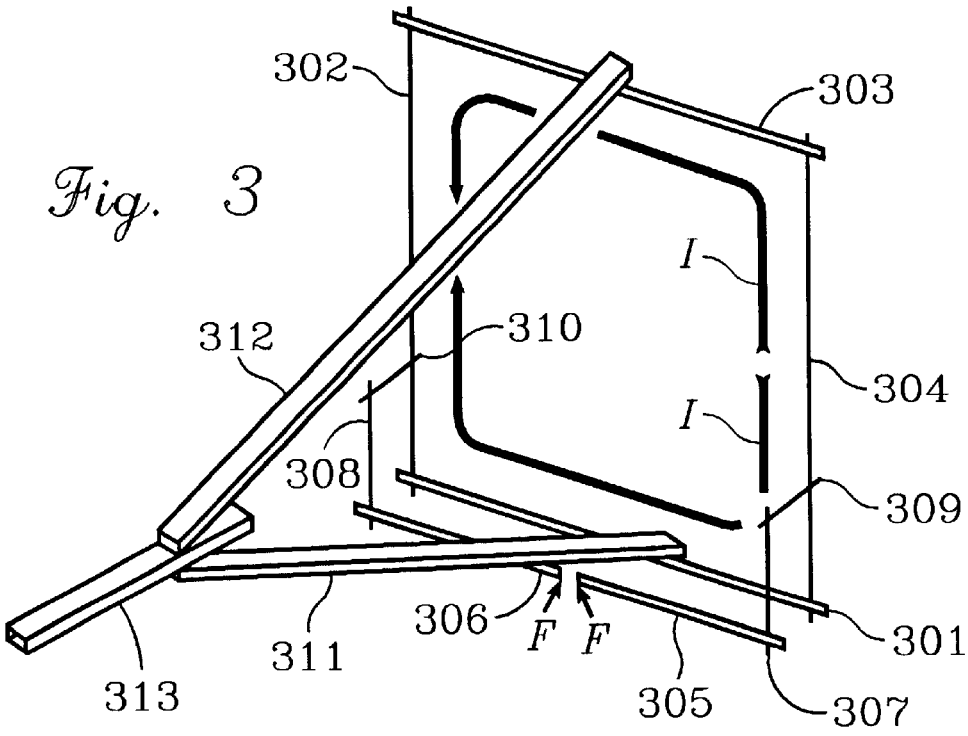
FIG. 3 illustrates a perspective view of a loop antenna element supported by diagonal supporting conductors, and best illustrates the essence of the invention.

In addition to the lines representing the conductors, there are wide arrows in FIGS. 1, 2 and 3 to indicate some aspects of the currents. One should not assume too much from these arrows. That is, these arrows indicate that the currents reach their maximum values at the centers of the arrows. They also indicate that the current values reach zero where the arrowheads and arrow tails face each other, and that the currents are travelling in opposite directions immediately beside those points. However, not much else should be assumed about these currents. Particularly, it should not be assumed that different currents necessarily have the same magnitudes and phases just because they are all called I.

In order to understand the following explanation, it also is necessary to introduce some terms. In FIG. 2, with parts 201 to 205, part 202 illustrates the plane of the loop, 201. Because the magnetic field is perpendicular to the main current paths at the top and bottom of the loop, plane 203 illustrates the plane of the magnetic field. Because this plane passes through the center of the loop, hereinafter in this discussion and attached claims, it will be called the principal H (magnetic field) plane, as is conventional practice. Likewise, the plane passing through the center of the loop that is perpendicular to both the plane of the loop and the principal H plane, 204, will hereinafter be called the principal E (electric field) plane, as is also conventional practice.

If the loop were symmetrical with respect to the ground, and the loop were fed in a balanced manner, the feed point would be at ground potential. In FIG. 1, the two generator symbols, 101A and 101B, are there to indicate that the loop is fed in a balanced manner with respect to ground. Because of the symmetry, away from that feed point there would be instantaneous voltages of equal magnitude but of opposite polarities at places that are equidistant from the feed point. The voltages would be of opposite polarities because no net current would flow between these points if they had voltages of the same polarity. At the point of the loop opposite from the feed point, in the center of part 104 in FIG. 1, these voltages of equal magnitude and opposite polarity would be the same voltage. The only voltage that satisfies those criteria is zero volts. That is, whatever the voltages would be at other places on the loop, they would reach zero at the place opposite the feed point. That is, that point would be at ground potential.

Therefore, a conductor, part 106, could be connected between those two grounded points and no current would flow in it because of that connection. Also, since the currents in corresponding parts of the two sides of the structure are equal in magnitude and opposite in phase, they will not induce any net voltage in the added central conductor. The top and bottom sides, 102 and 104, would not induce any significant voltage in part 106 because they are perpendicular to part 106. That is, if the loop were fed in a perfectly balanced manner, this additional conductor would have no electrical effect on the operation of the structure.

Of course, a perfect balance is not possible, but a reasonably balanced loop would produce an insignificant amount of current in the central conductor. Indeed, it is amazing how little current flows in this central conductor even when the structure is fed in an unbalanced manner. However, a balanced feeding system is preferred.

Note that the above explanation is not dependent on particular loop sizes. That is, although such loops usually have perimeters of one wavelength, loops of other sizes also could be supported in the same manner. Another way to view the point is to note that a loop would not be upset by such supports if it were used at a frequencies other than its resonant frequency. Also note that the shape of the loop is not significant to the above discussion. If the loop were symmetrical about the principal H plane, it could be circular or triangular, for example.

The idea of supporting loop antenna elements by conductors connected to the places that are at ground potential is not new. The article "Design of An All-Metal Quad," in Peter Dodd's book, *The Antenna Experimenter's Guide*, shows such a supporting system with the supporting conductors positioned perpendicular to the plane of the loop. The difficulty with this system is that if the antenna were rotated around a tower, the antenna should be positioned entirely above the tower so that the bottom support would not interfere with the tower. This system also requires that the mast extend up to the top supporting conductor, which would increase the weight and cost. Particularly if the antenna were large, it would be better to have the antenna attached to the mast at the center of the loops to minimize the stress on the mast. The system of the strengthened quad accomplishes that goal.

THE INVENTION

In FIG. 3, with parts 301 to 313, instead of having a conductor, 106, connected right across the loop to a boom, 107, there are two conductors, 311 and 312, mounted in the principal H plane and mounted diagonally with respect to the plane of the loop. They might connect to a boom, 313, or to a mast. These two conductors, 311 and 312, are the diagonal supporting conductors.

Also different from FIG. 1, instead of two generator symbols indicating a balanced feeding system, FIG. 3 has a T matching system. Except for the extensions, 307 and 308, to the conventional T parts, 305 and 306, it is a conventional T matching system. Usually the sides of a one-wavelength square loop are short enough that a convenient match cannot be obtained without such extensions. The usual tuning capacitors and balanced-to-unbalanced transformer attached to the feed points (F) were not shown because they are conventional and would unnecessarily complicate the diagram.

If the loop were balanced, because of the balanced T match, the centers of both the top and bottom of loop, 301 and 303, should be at ground potential. Therefore, no currents should flow in the diagonal supporting conductors and the boom, 311, 312 and 313, from that connection because they are connected to the grounded points. Also, because the diagonal supporting conductors are in the principal H plane, which is perpendicular to the plane of the loop and perpendicular to parts 301 and 303, these parts of the loop would not induce voltages into the diagonal supporting conductors. The sides of the loops, 302 and 304, would induce voltages into the diagonal supporting conductors, 311 and 312, because these conductors are partially parallel to these two sides of the loop. However, because the currents in the corresponding parts of the sides of the loops are flowing in opposite directions, no net voltages would be induced in the diagonal supporting conductors. Similar arguments could be made for the radiation from the parts of the T matching system. Therefore, these diagonal supporting conductors would have no electrical effect on the operation of the loop as long as they were entirely in the principal H plane.

Whether the pair of diagonal supporting conductors of FIG. 3 would be lighter and less expensive than the boom and single supporting conductor of FIG. 1 depends on the dimensions. It is perhaps obvious that if conductors 311 or 312 were approximately as long as either conductors 106 or 107, there would be no advantage in weight or cost. Between these extremes, there could be such an advantage. However, there is another advantage. In windy conditions, the arrangement of FIG. 1 would allow conductors 102 and 104 to move back and forth rather easily. That is, more strength would be required to reduce the movement in windy conditions than the strength required just to avoid a mechanical failure. Since conductors 102 and 104 carry the maximum current and are, therefore, the most important parts of the loop, when they change their positions relative to the other loops in the antenna, they change the performance of the antenna. Because there are two diagonal supporting conductors in FIG. 3 attached to the centers of the high-current parts of the loop, those parts of the loop would move less in the wind.

Figure 4:
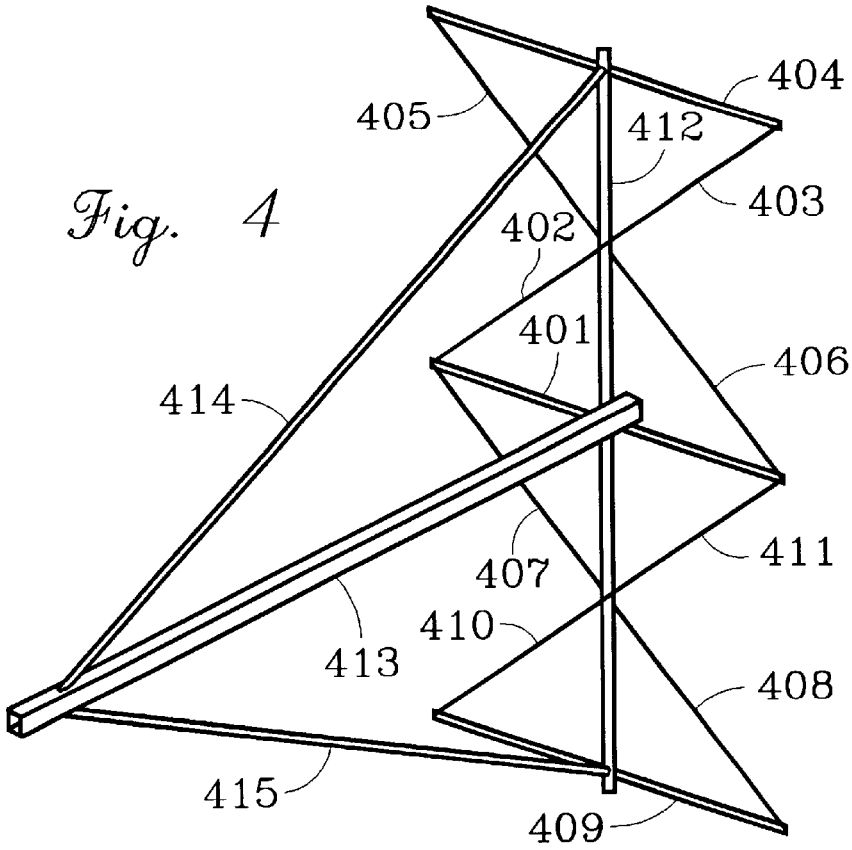
FIG. 4 illustrates a perspective view of a multiloop antenna element that has both supporting conductors placed directly across the loops and supporting conductors placed diagonally with respect to the loops.

For a set of loops, such as the center-fed Quadruple-Delta Antenna Structure of FIG. 4 and U.S. Pat. No. 5,966,100, the same kind of diagonal supporting conductors can be used. The feeding system was not shown because it would be conventional and it would unnecessarily complicate the diagram. If the set of loops were symmetrical with respect to the principal H plane, the voltages in the conductors on one side of the antenna would be equal in magnitude and opposite in phase from the voltages on the opposite side. Therefore, the voltages at the outer points must be zero volts. Likewise, the radiation from one side of the antenna to any supporting conductors in the principal H plane would be cancelled by the radiation from the other side. Therefore, the diagonal supporting conductors would have no currents in them no matter how many loops were in such a set of loops.

This problem of the antenna moving in the wind is likely to be more severe with large multiloop antenna elements like the quadruple delta. Because of its size, it probably would move more than a smaller antenna. In addition, an antenna using such elements probably would have a higher gain and, therefore, the distances between the elements probably would be more critical. For that reason, it could be worthwhile to support the quadruple delta antenna, with parts 401 to 411, with both a boom, 413, and a conductor directly across the element, 412, plus diagonal supporting conductors 414 and 415. If such a large antenna element were supported only at the top and bottom, it may be that the center would move too much in the wind.

One may get the impression that this multitude of supports would produce a rather heavy and expensive system, but that may not be the case. These additional supporting conductors might not simply add weight and cos, because they would support the antenna elements as well as provide a means of reducing the movement in the wind. That is, the additional diagonal supporting conductors may allow a reduction in the weight and cost of the boom, and the conductor positioned directly across the element may not be needed at all.

Figure 5:
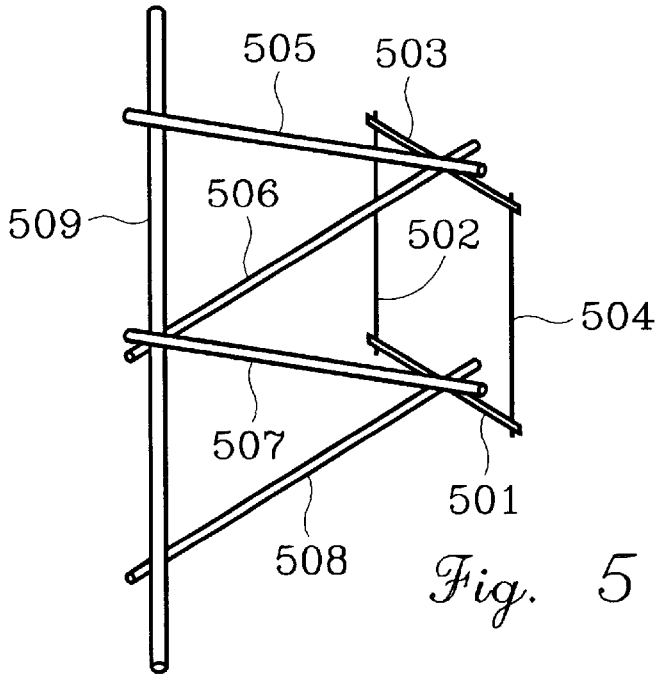
FIG. 5 illustrates a perspective view of a loop antenna element supported by several diagonal supporting conductors.

The idea of the diagonal supporting conductors meeting each other at a central point, as in FIGS. 3 and 4, has the same advantage as has the strengthened quad when the antenna is rotated. That is, there are no parts below the center of the loops that would interfere with the tower when the antenna is rotated around the tower. However, not all antennas are rotated and sometimes towers are rotated. If the loop were large, it might be necessary to support the loop with several diagonal supporting conductors, as in FIG. 5. In this diagram, the loop with parts 501 to 504 has four diagonal supporting conductors, 505 to 508, to connect it to a mast, 509. The mast, of course, could be a tower. Since all of the diagonal supporting conductors are in the principal H plane, they should have no significant effect on the electrical performance of the loop. Whether the diagonal supporting conductors are positioned diagonally toward the center of the structure or diagonally away from center would make no significant difference to the electrical performance of the loop.

Figure 6:
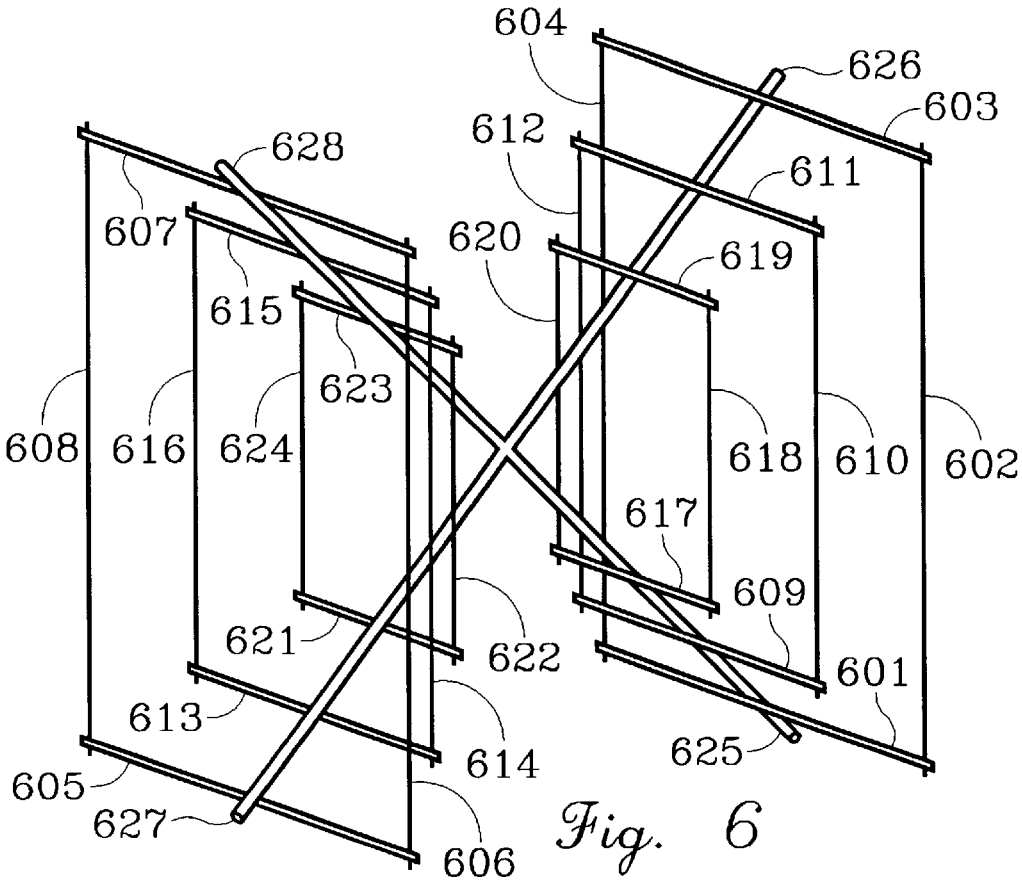
FIG. 6 illustrates a perspective view of an array of loops antenna elements supported by diagonal supporting conductors.

A more common situation is illustrated by FIG. 6, with parts 601 to 628. It is common practice in amateur radio to have an antenna that covers the three bands at 14, 21 and 28 megahertz. A common example is the boomless quad, which resembles FIG. 6. In this diagram, parts 601 to 608 would be a two-element Yagi-Uda array for the lowest frequency band, and parts 609 to 616 plus parts 617 to 624 would likewise serve the higher frequency bands. In the traditional antenna, there would be eight long insulators extending from the central point to the eight trios of corners of the square loops. Because there are three sets of loops carried by the long insulators, the stress on the insulators would be severe in an ice storm. In FIG. 6, only four diagonal supporting conductors, 625 to 628, are needed to do the same job. Because the diagonal supporting conductors are metal, they can made as strong as is necessary. In addition, because of the stress on the long insulators, the loops are traditionally made with small diameter wires to reduce the weight, but this reduces the bandwidth of the antenna. With the diagonal supporting conductors, the loops can be made of large tubing to increase the bandwidth.

Although it is usual practice to use conductors of circular cross-section for antennas, there is no such need for the diagonal supporting conductors. Radio-frequency currents tend to flow in the outer parts of conductors, because of the skin effect, so the currents tend to flow in the corners of square conductors, for example. Therefore, it is better to use round conductors for antennas, because there is more metal in their outer parts since the entire surfaces are their outer parts. However, the diagonal supporting conductors should not have current flowing in them, so there is no electrical reason for not using other shapes for supporting conductors, like the booms, 313 and 413, in FIGS. 3 and 4. Likewise, there is no electrical reason to avoid a relatively poor conductor, like steel, instead of the usual antenna materials, aluminum and copper. It also is possible to use tubes or solid rods for diagonal supporting conductors. Tubes usually are less expensive in large sizes and rods are less expensive in small sizes.

While this invention has been described in detail, it is not restricted to the exact embodiments shown. These embodiments serve to illustrate some of the possible applications of the invention rather than to define the limitations of the invention.

I claim:

1. A diagonal supporting conductor for an approximately coplanar loop antenna, such that:

(a) said loop antenna is approximately symmetrical with respect to the principal H plane of said loop antenna;

(b) said loop antenna is fed in an approximately balanced manner;

(c) said loop antenna is fed at a point on said loop antenna that is approximately at said principal H plane;

(d) said diagonal supporting conductor is electrically and mechanically connected from a supporting boom, mast or tower to a place on said loop antenna that is approximately at ground potential for the frequency of operation;

(e) said diagonal supporting conductor is disposed diagonally with respect to the plane of said loop antenna; and (f) said diagonal supporting conductor is disposed so that said diagonal supporting conductor is substantially within said principal H plane of said loop antenna.

2. The diagonal supporting conductor of claim 1 wherein the cross-sectional area of said diagonal supporting conductor is tubular.

3. The diagonal supporting conductor of claim 1 wherein the cross-sectional area of said diagonal supporting conductor is solid.

4. The diagonal supporting conductor of claim 1 wherein the cross-sectional area of said diagonal supporting conductor is circular.

5. The diagonal supporting conductor of claim 1 wherein the cross-sectional area of said diagonal supporting conductor is rectangular.

6. The diagonal supporting conductor of claim 1 wherein the cross-sectional area of said diagonal supporting conductor is square.

7. The diagonal supporting conductor of claim 1 wherein said loop antenna has only one loop with a perimeter of approximately one operating wavelength.

8. The diagonal supporting conductor of claim 1 wherein said loop antenna has more than one loop.

9. A plurality of diagonal supporting conductors for an approximately coplanar loop antenna, such that:

(a) said loop antenna is approximately symmetrical with respect to the principal H plane of said loop antenna;

(b) said loop antenna is fed in an approximately balanced manner;

(c) said loop antenna is fed at a point on said loop antenna that is approximately at said principal H plane;

(d) each of said diagonal supporting conductors is electrically and mechanically connected from a supporting boom, mast or tower to a place on said loop antenna that is approximately at ground potential for the frequency of operation;

(e) each of said diagonal supporting conductors is disposed diagonally with respect to the plane of said loop antenna; and (f) each of said diagonal supporting conductors is disposed so that each of said diagonal supporting conductors is substantially within said principal H plane of said loop antenna.

* * * * *